US007824059B1

(12) United States Patent
Swarens

(10) Patent No.: US 7,824,059 B1
(45) Date of Patent: Nov. 2, 2010

(54) LOW-GLARE INTEGRALLY-RECESSED CEILING LIGHT FIXTURES

(76) Inventor: Ralph W. Swarens, LaVerne, CA (US); Toni F. Swarens, legal representative, 1830 Olivewood St., LaVerne, CA (US) 91750

( * ) Notice: Subject to any disclaimer, the term of this patent is extended or adjusted under 35 U.S.C. 154(b) by 373 days.

(21) Appl. No.: 11/514,039

(22) Filed: Sep. 1, 2006

Related U.S. Application Data

(62) Division of application No. 10/273,635, filed on Oct. 21, 2002, now Pat. No. 7,108,394.

(51) Int. Cl.
*F21S 8/00* (2006.01)

(52) U.S. Cl. ..... 362/147; 362/146; 362/364

(58) Field of Classification Search ..... 362/147, 362/364, 148, 150, 365, 368
See application file for complete search history.

(56) References Cited

U.S. PATENT DOCUMENTS

| | | | |
|---|---|---|---|
| 1,799,304 | A | 9/1928 | Logan |
| 2,465,248 | A | 3/1949 | McCandless |
| 2,998,511 | A | 8/1961 | Chan |
| 3,040,172 | A | 6/1962 | Chan |
| 4,232,361 | A | 11/1980 | Kelsall |
| 4,748,543 | A | 5/1988 | Swarens |
| 5,142,459 | A | 8/1992 | Swarens |
| 5,988,836 | A | 11/1999 | Swarens |
| 6,082,878 | A | 7/2000 | Doubek et al. |
| 6,364,511 | B1 | 4/2002 | Cohen |
| 6,568,826 | B1 | 5/2003 | Kotovsky |
| 6,913,369 | B2 * | 7/2005 | Chadwick ..... 362/147 |
| 2003/0086258 | A1 | 5/2003 | Kotovsky |

FOREIGN PATENT DOCUMENTS

WO WO 0012840 A1 * 3/2000

OTHER PUBLICATIONS

HITW Series, Engineered Lighting Products, first published 1990.*
HITC Series, Engineered Lighting Products, first published 1994.*
GRG Achitectural Lighting Fixtures, HITC and HITW Series, Engineered Lighting Products 2002 (HITC Series first available 1994, HITW Series first available 1990).*

* cited by examiner

*Primary Examiner*—Hargobind S Sawhney
(74) *Attorney, Agent, or Firm*—J. E. McTaggart

(57) ABSTRACT

A line of recessed low-glare lighting fixtures, known as HITC (hole-in-the-ceiling), provide an authentic architectural built-in appearance. A mounting unit is cast in plaster material with a vertical duct extending upwardly from a light-exit opening in a horizontal face flange that becomes plastered in place in the ceiling. The duct supports a light source and associated components above, producing a light beam of designated beam width, typically +/−45 degrees. From any room viewpoint outside the light beam, the only component of the fixture that is visible is the mounting unit, of which all visible regions, both internal and external, are made to have finish, appearance and texture that match and blend in harmoniously with the surface of the surrounding ceiling.

7 Claims, 6 Drawing Sheets

LOW-GLARE INTEGRALLY-RECESSED CEILING LIGHT FIXTURES

Benefit is claimed under 35 U.S.C. 121 as a division of application Ser. No. 10/273,635 filed Oct. 21, 2002 now U.S. Pat. No. 7,108,394, by the same inventor, allowed May 7, 2006.

FIELD OF THE INVENTION

The present invention relates to the field of built-in electric lighting products, and more particularly it relates to method and structure of a product line of low-glare light fixtures for permanent installation in a fully recessed manner, typically in a ceiling.

BACKGROUND OF THE INVENTION

The evolution in both commercial and residential indoor lighting has been characterized by progress in two directions simultaneously: along with improvements in technical/functional efficiency and variety of options available in implementation and in the quality of illumination produced, there is ongoing development in the styling and aesthetic aspects of indoor light fixtures and enclosures.

Ceiling lighting has relied heavily on hanging fixtures in the past but has evolved increasingly in the direction of recessed fixtures, notably well known fluorescent fixtures with a translucent light-diffusing panel surrounded by a frame or ceiling suspension rails. For a more subdued, relaxing effect, a pattern of similar or identical light fixtures may be recessed into a ceiling region. However such recessed fixtures are typically configured with an exposed flange, surrounding the light-exit opening in the ceiling, which draws attention as a discontinuity that detracts from the overall room aesthetics where an architectural effect of quiet relaxation is sought whether in a living room or a public building.

DESCRIPTION OF KNOWN ART

In fixtures of well-known fluorescent type used widely in suspended sub-ceilings, a rectangular diffusing panel is framed by surrounding inverted T-bar suspension rails and becomes, in effect, a recessed ceiling fixture. In the less common category of recessing into plastered ceilings and walls, including regular plaster or drywall, it has been necessary to provide some sort of decorative metal frame or molding around the perimeter of the fixture to hide the unavoidable gap between the opening in the ceiling or wall and the perimeter of the fixture.

For ceiling lighting situations where a subtle architectural effect is desired instead of the usual utilitarian flourescent approach, a pattern of recessed fixtures may be deployed. Fixtures of this type in known art have generally required some form of exposed frame or mounting ring which, as with the aforementioned fluorescent fixtures, appears as a discontinuity. Although such frames or moldings are often considered aesthetically undesirable and detrimental, there may be no way of eliminating them if they serve an essential function such as concealing unsightly structure or providing service/maintenance access that requires temporary removal or detachment.

Even fixtures of known art that may be plastered in place in a ceiling fall short of a desired built-in appearance when interior surfaces and/or components such as baffle ridges, metalized or other reflecting surfaces, brackets, gaskets, components, etc., are not concealed but are allowed to remain visible as a distraction to a viewer from regions of the room outside the beam region. Even subtle differences from the surrounding ceiling region in color, texture or surface properties of visible surfaces in the fixture detract from a desired truly authentic built-in architectural appearance.

OBJECTS OF THE INVENTION

It is a primary object of the present invention to provide a low-glare lighting fixture configuration for recessed installation into a plastered ceiling of usual plaster and drywall or gypsum lath construction, in a manner that does not require a frame or trim strip around the perimeter, with the result that the finished installation appears to be an integral original part of the wall or ceiling.

It is a further object that the lighting fixture be configured with provisions to facilitate ceiling installation both in new construction and in pre-existing ceilings It is a further object to provide a product line of recessed ceiling light fixtures that project a generally conical light beam of designated beam width and that are structured in a manner that, from any room viewpoint outside the light beam, the only component of the fixture that is visible is a mounting unit of which all visible regions, both internal and external, are made to have finish, appearance and texture made to match and blend in with the surface of the surrounding ceiling to achieve a built-in architectural effect.

It is a further object to configure the light fixtures primarily with the duct cross-section and the light-exit aperture made generally circular or square, with options of other polygonal or special shapes.

It is a further object to provide for embodiments implemented with fluorescent, incandescent or HID (high intensity discharge) lamps such as metal halide.

SUMMARY OF THE INVENTION

The above-mentioned objects have been met by the present invention of a system of recessed low-glare lighting fixtures, known as HITC (hole-in-the-ceiling), featuring a special mounting unit that can be cast from fiber-reinforced plaster and made in different sizes depending on wattage ratings, with a rectangular, typically square, horizontal face flange configured with a circular or optionally, square or central light-exit opening from which a duct extends upwardly to form the general shape of a top hat. The cast mounting unit supports a light source assembly that can be incandescent, fluorescent or HID, in a selection of wattage ratings, with components and wiring contained in or attached to a code-compliant enclosure. The assembly is readily installed via the mounting unit by regular tradesmen in new construction or retrofit. The mounting unit is fastened along the margins of the face flange to a stud frame formed in a ceiling with the four edges of the face flange butt-joining adjacent drywall or gypsum plaster board. The joints are then taped and finish-plastered in a normal manner to provide a totally built-in integrated appearance with finish plaster extending uniformly to the edge of the light opening, with no need for molding or other trim parts.

The fixture is structured in a manner to produce a light beam of designated beam width, typically +/−45 degrees, and to ensure that, from any room viewpoint outside the light beam, the only component of the fixture that is visible is the mounting unit of which all visible regions, both internal and external, are made to have finish, appearance and texture that match and blend in with the surface of the surrounding ceiling, thus achieving the desired authentic built-in architectural effect.

The electrical assembly connects to the AC power line, in a normal manner. All replacement and maintenance can be performed from the room through the light-exit opening.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
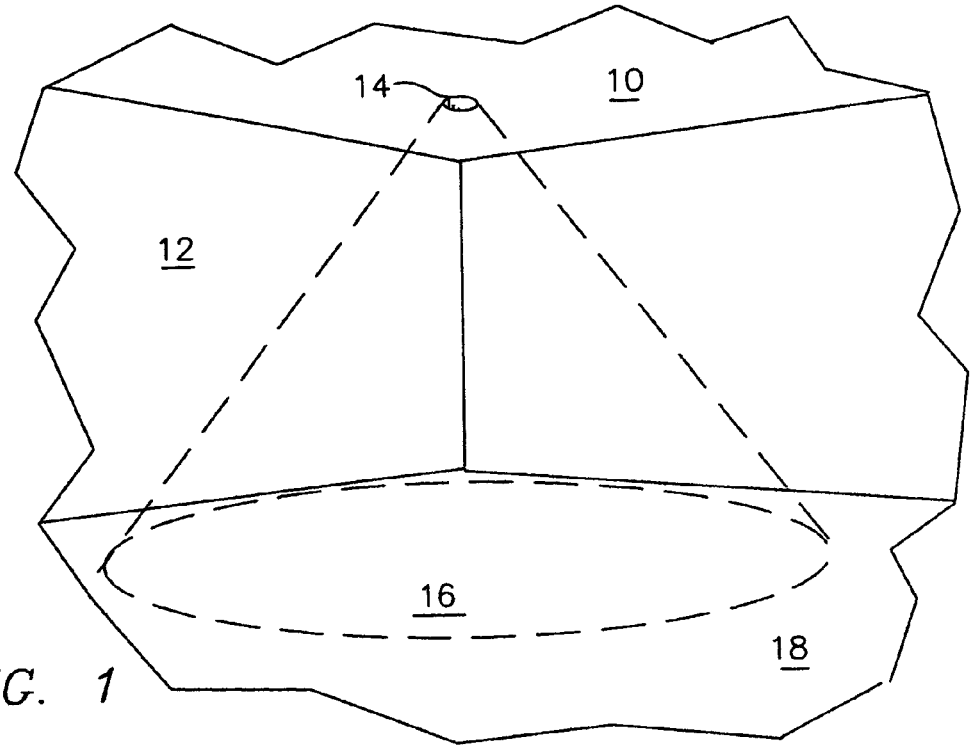
FIG. 1 is a perspective view of a corner portion of a room of which the ceiling is fitted with a low-glare light fixture of the present invention in an embodiment with a circular light-exit aperture.

FIG. 1 is a perspective view showing a corner portion of a room with the ceiling 10, supported above walls 12. Recessed into the ceiling 10 is a low glare light fixture, in an embodiment of the present invention, configured with a circular light-exit aperture 14, producing a circular field of illumination 16 on the floor 18, as indicated by dashed lines.

Figure 2:
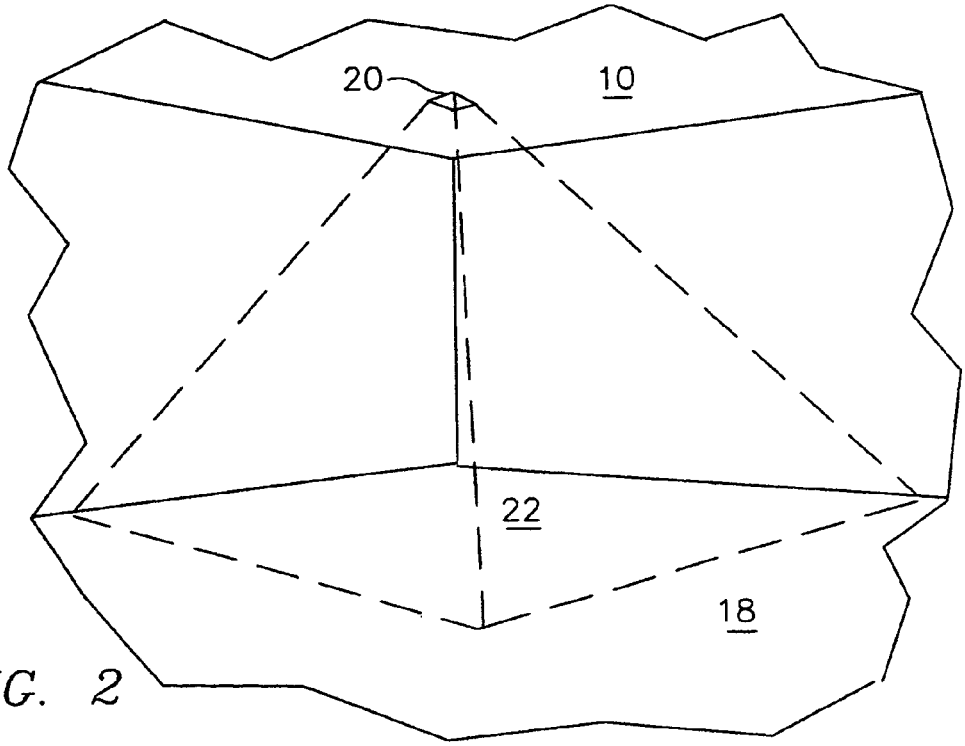
FIG. 2 is a perspective view of a corner portion of a room of which the ceiling is fitted with a low-glare light fixture of the present invention in an embodiment with a square light-exit aperture.

FIG. 2 is a perspective view of a corner portion of a room as in FIG. 1 showing a ceiling 10 fitted with a low glare light fixture in an embodiment of the present invention configured with a square light-exit aperture 20, producing a square field of illumination 22 on the floor 18 as indicated by dashed lines.

Figure 3:
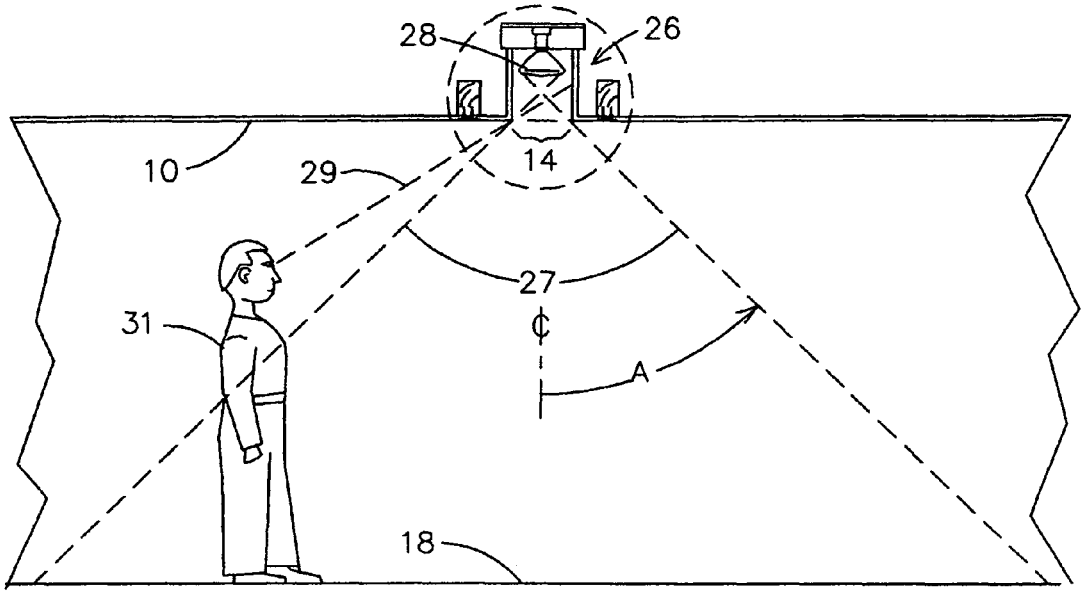
FIG. 3 is a cross-sectional elevation of a portion of a room fitted a low-glare light fixture of the present invention installed in the ceiling, showing the beam region and a room occupant with eye level outside the beam region.

FIG. 3 is a cross-sectional elevation of a portion of a room fitted with a low-glare light fixture installed in the ceiling 10 via a mounting unit 26 which is the key element of the present invention, enclosing a lamp 28.

The half-intensity limits of the light beam, established by the light-exit aperture 14 of the mounting unit 26 and the location and size of the lamp 28, are shown by the dashed lines 27 which indicate the region of the light beam extending to the floor 18.

As a key principle of the invention, in its preferred embodiments, the fixture and its light-exit aperture are made, dimensioned and arranged to project a conical beam having an angle A of approximately +/−45 degrees from the central axis C and thus the total beam-width is made to be approximately 90 degrees, producing a circular field of illumination on the floor 18 as shown in FIG. 1A. Accordingly, from any viewpoint in the room outside the light beam 27, the direct light source of lamp 28 remains concealed.

The key principle of the invention further requires that, from all viewpoints outside the light beam, not only the lamp, but all other associated components remain concealed from view, with the exception of the inside wall of the duct portion and the bottom side of the flange portion of mounting unit 26, and these must have the same finish, texture and appearance as the surrounding ceiling 10, in order accomplish a unique totally built-in appearance and perception. This principle is illustrated in FIG. 3 by the line-of-sight path 29 from the eye of room occupant viewer 31 past the proximal edge of the circular light-exit aperture 14 of the fixture in ceiling 10, so that all fixture components are concealed from view.

Figure 4:
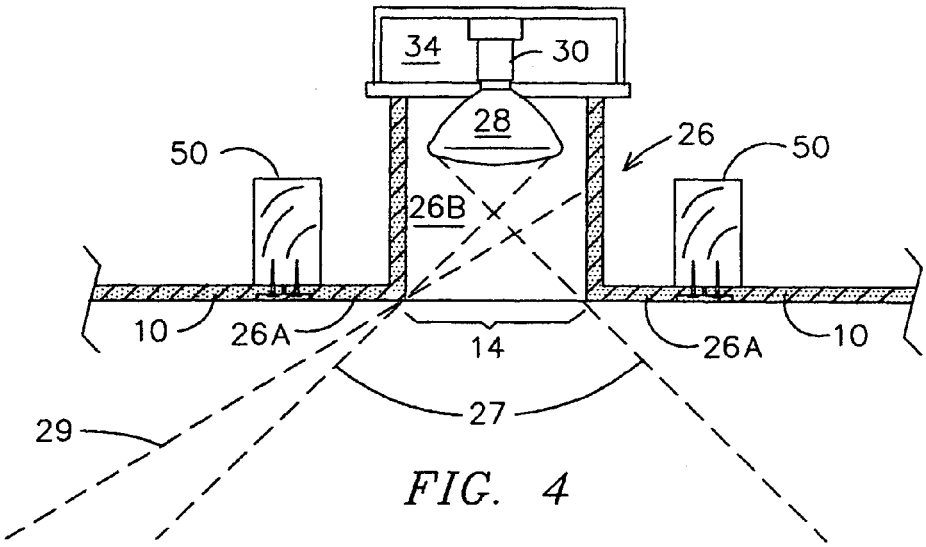
FIG. 4 is an enlargement of an upper portion of FIG. 3.

FIG. 4 shows an enlargement of the upper portion of FIG. 3 encircled by broken lines. The viewer's line-of-sight 29 illustrates that the only thing that can been seen of the light fixture are portions of mounting unit 26: the lower surface of the horizontal flange portion 26A of mounting unit 26 which is made indistinguishable from the surrounding ceiling 10, and the distal interior wall of the vertical duct portion 26B which, in accordance with key principle of the invention, is also made to have the same finish, texture and appearance as the surrounding ceiling 10, typically a plaster finish.

Flange portion 26A is typically made with a square outline which is supported by structural studs 50 and finished on the underside to blend in with the surrounding ceiling 10, typically plastered in place in the manner of drywall. Flange portion 26A is configured with a centered circular light exit aperture from which a tubular vertical duct portion 26B extends upwardly, to a height no less than its inner diameter, i.e. the diameter of the light-output aperture. At the top end, duct portion 26B supports an enclosure box 34 fitted with a lamp socket 30 holding lamp 28. Box 34 is configured with knockouts for electrical cable attachment.

In order to make the beam width +/−45 degrees from vertical, i.e. 90 degrees total, as practiced in preferred embodiments of the invention, the effective point source, i.e. the crossover point of beam 27, must be located above the light-exit aperture by a distance equal to half its major dimension, i.e. the radius of circular light-exit aperture, while the lamp 28 must be located above the effective point source by a distance equal to half its major dimension, i.e. radius of a circular lamp. Thus, for the desired concealment, geometry requires the height of the duct portion 26B to be made greater than the major horizontal dimension of the light-output aperture, e.g. greater than 6 inches high for a 6 inch circular aperture, and greater than 8.5 inches (the diagonal $6\times\sqrt{2}$) for a 6"×6" square aperture.

Figure 5:
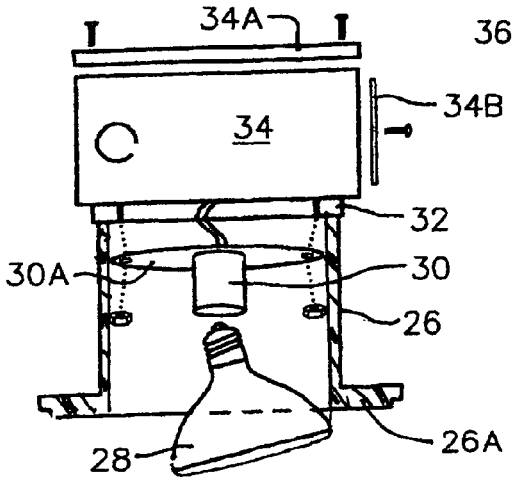
FIG. 5 is a functional partially cross-sectioned side view of a version of the ceiling type light fixture of the present invention that utilizes a relatively low wattage incandescent lamp.

FIG. 5 is a functional side view of a low power incandescent version of a ceiling type light fixture embodiment of the present invention. Mounting unit 26, indicated in cross-section to show electrical components in process of installation, is cast integrally in the general shape of a "top hat" from a fiber-reinforced plaster composition, to be built into a ceiling and become the structural support and recessed duct/light-exit aperture of the electrical fixture assembly.

Mounting unit 26 is configured with a rectangular, typically square, horizontal bottom face flange 26A having a central light-exit aperture that can be made square or circular, from which a main hollow column extends upwardly typically six to eight inches to clear surrounding framing studs and to recess the light source sufficiently to create a built-in appearance from the room below, as previously described, and to make the beam width nominally 45 degrees from vertical.

The light source in this embodiment is an incandescent lamp 28, which, for this low power version, can range up to 75 watts. Lamp 28 screws into socket 30 which is attached to a metal mounting plate 30A that is removably attached to the bottom side of metal enclosure box 34, which is attached to a collar 32 attached on top of mounting unit 26. The "top-hat" enclosure box 34 is configured with knockouts for electrical cable attachment and fitted with access cover plates 34A on top and 34B on the side.

For this embodiment, the face flange 26A of mounting unit 26 is made 8½ inches square and the light-exit aperture dimension is made 4½ inches (diameter in the circular version; per edge in the square version).

Figure 6:
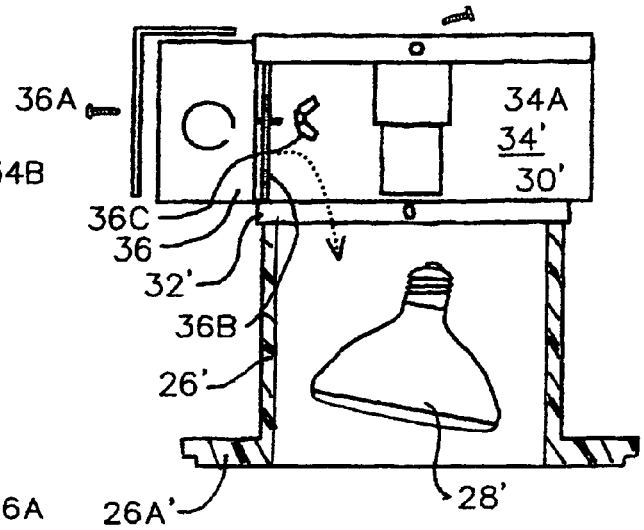
FIG. 6 shows a larger version of fixture of FIG. 5 utilizing a higher wattage incandescent lamp.

FIG. 6 is a functional side view of a higher power version of the incandescent ceiling type light fixture embodiment of the present invention that is made larger than that shown in FIG. 5, so that the incandescent lamp 28' can range up to 150 watts. Socket 30' is mounted to via a bracket to the lid 34A' of box 34' which is attached to mounting unit 26' via collar 32'. An electrical wiring hookup area 36 is fitted with an external cover plate 36A and an internal cover plate 36B which is retained in place by a pair of wing-nuts 36C that are accessible from below through mounting unit 26'.

In a lower power version, up to 90 watts, the face flange 26A' of mounting unit 26' is made 9¾ inches square and the light-exit aperture dimension is made 6 inches. In a higher power version, up to 150 watts, the face flange 26A' of mounting unit 26' is made 11¾ inches square and the light-exit aperture dimension is made 8 inches.

Figure 7:
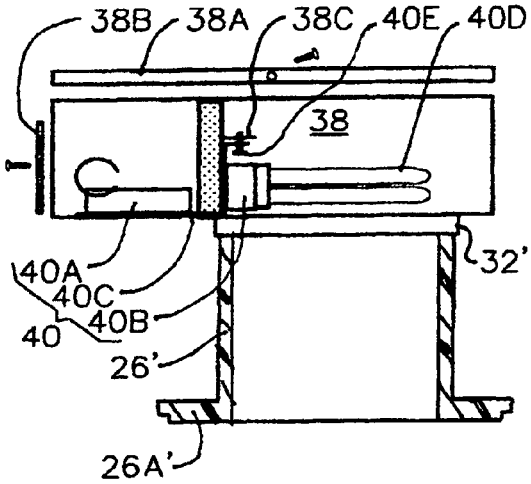
FIG. 7 is a functional partially cross-sectioned side view of a fluorescent version of the ceiling type light fixture of the present invention.

FIG. 7 is a functional side view of a fluorescent ceiling type light fixture embodiment of the present invention. An elongated box 38, fitted with a top cover plate 38A and an end cover 38B, is supported on mounting unit 26' via the collar 32'. Box 38 surrounds and supports a fluorescent light assembly 40 that includes a ballast 40A, along with a pair of sockets 40B, mounted together on a Z-shaped mounting plate 40C and supporting a pair of U shaped fluorescent tubes 40D.

Assembly 40 is retained in place by a screw 40E traversing the upper flange of mounting plate 40C and engaging a bracket 38C affixed to box 38.

U-shaped fluorescent tubes 40D are engaged in socket 40B. Assembly 40 may have 1 or 2 quad or triple lamps, ranging from 13 watts to 42 watts.

In a lower power version, up to 26 watts, the face flange 26A is made 9¾ inches square and the light-exit opening dimension is made 6 inches. In a higher power version, up to 42 watts, the face flange 26A' is made 11¾ inches square and the light-exit opening dimension is made 8 inches.

Figure 8:
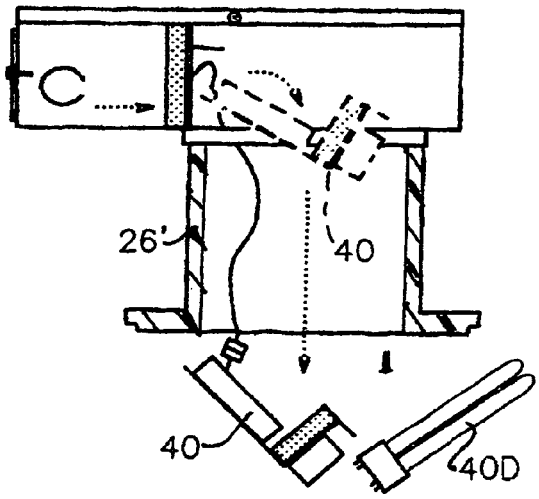
FIG. 8 shows the fixture of FIG. 7 with the fluorescent lamp unit and its ballast in process of being removed for service or maintenance.

In FIG. 8, the fixture of FIG. 7 is shown with the fluorescent lamp assembly 40 in process of being removed through the mounting unit 26' for service or maintenance purposes. Upon removal of tubes 40D and retaining screw 40E (FIG. 7) the assembly 40 is moved into the upper region as shown in dashed lines, then lowered through the mounting unit 26' as indicated by the arrow to the position shown below, where it can be disconnected and removed.

Figure 9:
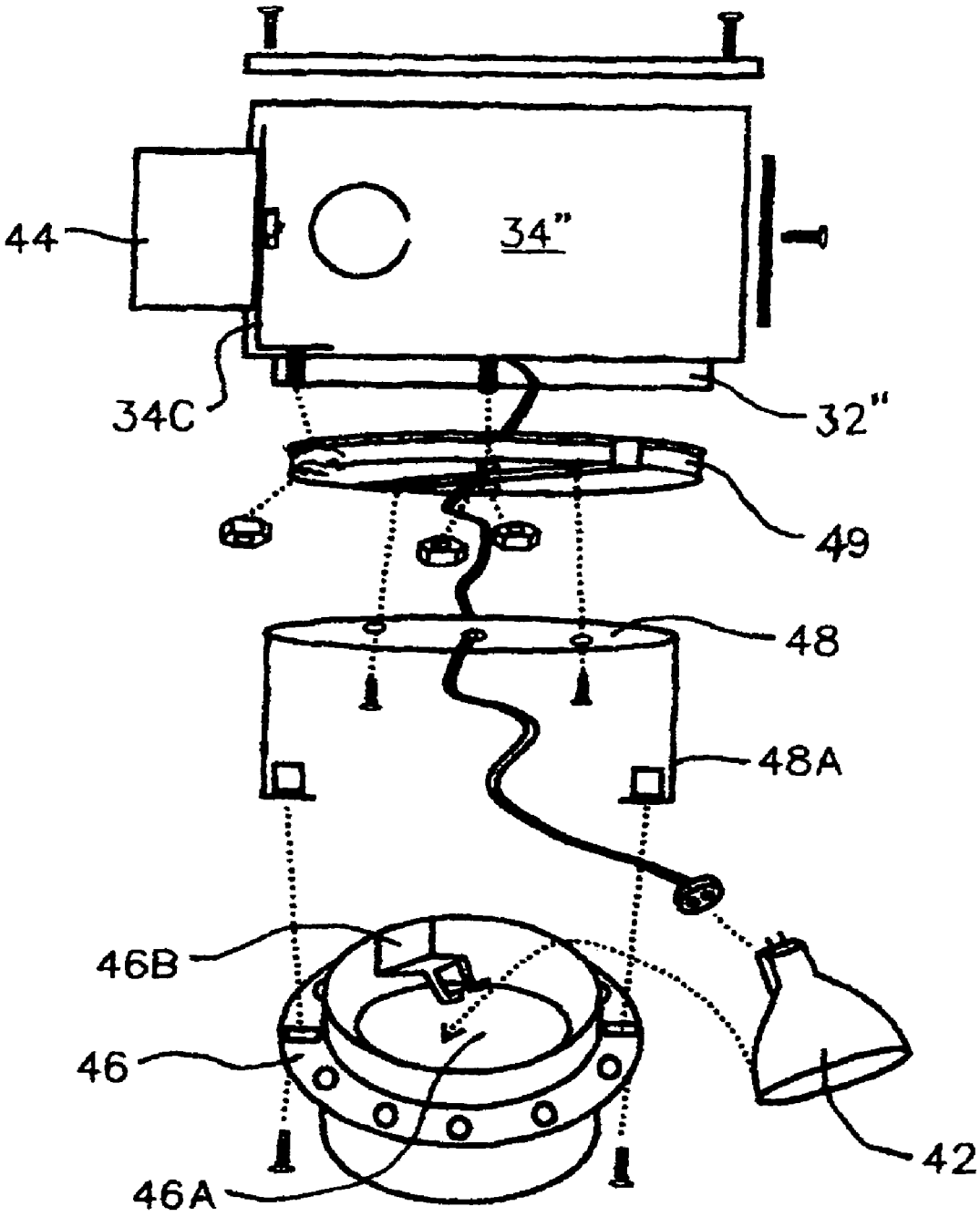
FIG. 9 is an exploded side view of a version of the ceiling type light fixture of the present invention utilizing a low voltage halogen lamp.

FIG. 9 is an exploded side view of a ceiling type light fixture embodiment of the present invention that utilizes a low voltage halogen lamp 42 and associated power transformer 44. Lamp 42 is supported in face down orientation by a lamp spinning 46 (spun from sheet metal) containing a lens 46A. Spinning 46 is attached by bolts through its edge flange engaging fixed nuts in arms 48A of metal holder 48, which is attached to access plate 49 by two screws, as shown. Access plate 49, which provides recessed regions on its lower side where insulation can be deployed, is attached to the bottom of "Top hat" wiring enclosure 34" by bolts extending downwardly and nuts accessible from below through the mounting unit, not shown in this figure. The collar 32" attaches the mounting unit to the overhead wiring enclosure 34" which is attached to access plate 49.

Power transformer 44 on one side, is attached to an L shaped bracket 34C which is held in place by a stud and nut, supplies low voltage to lamp 42 through a cable and connector as shown.

FIGS. 5-9 are intended for illustrative purposes only and not for scaling or proportioning.

Figure 10:
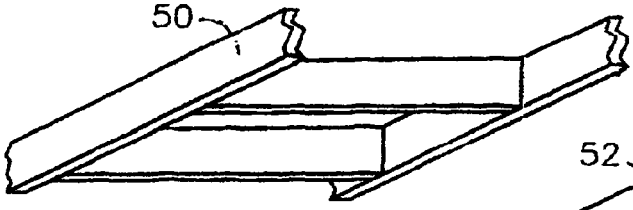
FIG. 10 is a perspective view of a square opening provided in building construction framing for installing a low-glare recessed light fixture of the present invention into a ceiling region.

FIG. 10 is a perspective view of building construction framework, typically of conventional "two by four" studs 50, configured to provide a square opening of specified size for installing a light fixture of the present invention into a ceiling region.

Figure 11:
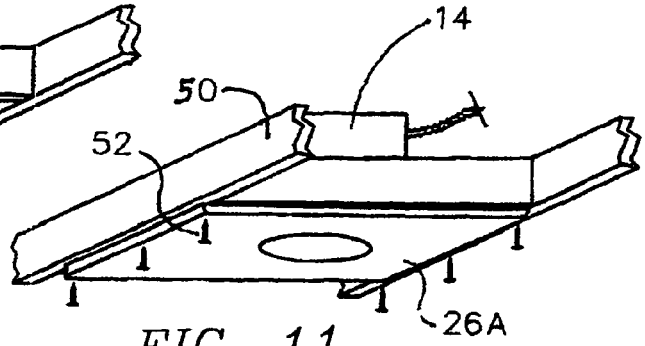
FIG. 11 depicts the framing of FIG. 10, with a light fixture mounting unit of the present invention being installed in place.

FIG. 11 depicts the framework of FIG. 10, with a light fixture 14 of the present invention being installed in place, preferably by a row of screws 52 engaging stud 50 through pre-drilled holes along a pair of opposite edges of the face flange 26A of the mounting unit, as shown.

Figure 12:
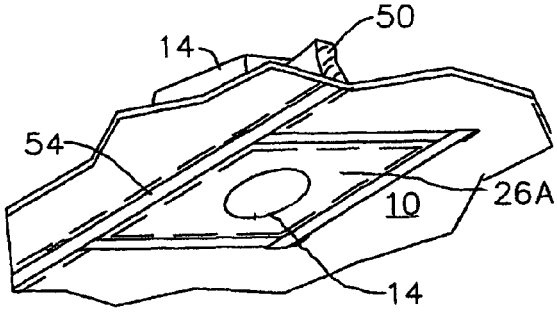
FIG. 12 depicts the items of FIG. 11 with the addition of surrounding drywall board, with the peripheral joint taped ready to plaster.

FIG. 12 depicts the items of FIG. 11 with the addition of drywall board installed in place in ceiling 10 all around fixture 14, with the joint covered by drywall joint tape 54, ready for plastering.

Figure 13:
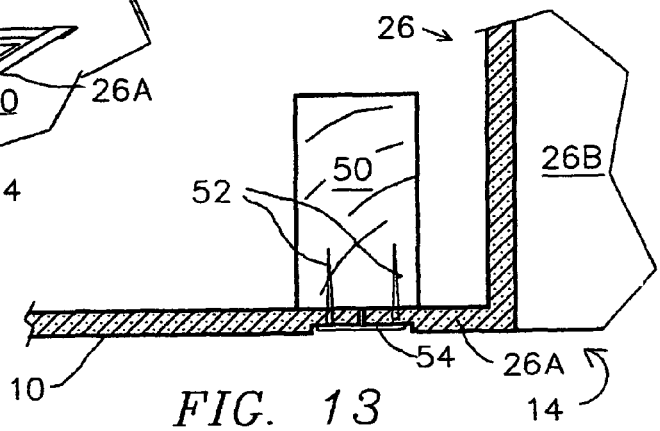
FIG. 13 is a cross-section taken at an edge region of the light fixture of FIG. 12 showing the taped joint.

FIG. 13 is a cross-section taken at an edge of the face flange 26A of FIG. 12 showing the join covered by drywall joint tape 54, ready for plastering.

Figure 14:
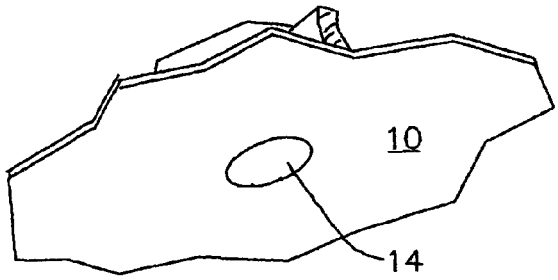
FIG. 14 is a perspective view as in FIG. 12 with the addition of finish plaster, showing the final appearance.

FIG. 14 is a perspective view as in FIG. 12 with the addition of finish plaster 56, showing the final unified appearance of the light exit aperture 14 of the fixture blending continuously with ceiling 10, as seen by a room occupant.

Figure 15:
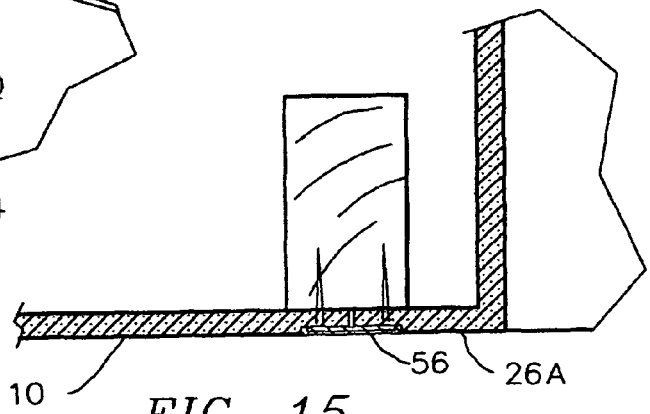
FIG. 15 is a cross-section as in FIG. 13 with the addition of finish plaster, showing the final appearance.

FIG. 15 is a cross-section as in FIG. 13 with the finish plaster 56 applied, concealing the joints and tape 54 to give an integrated overall appearance, uniformly plastered to the edge of the light-exit opening 14 in face flange 26A.

Figure 16:
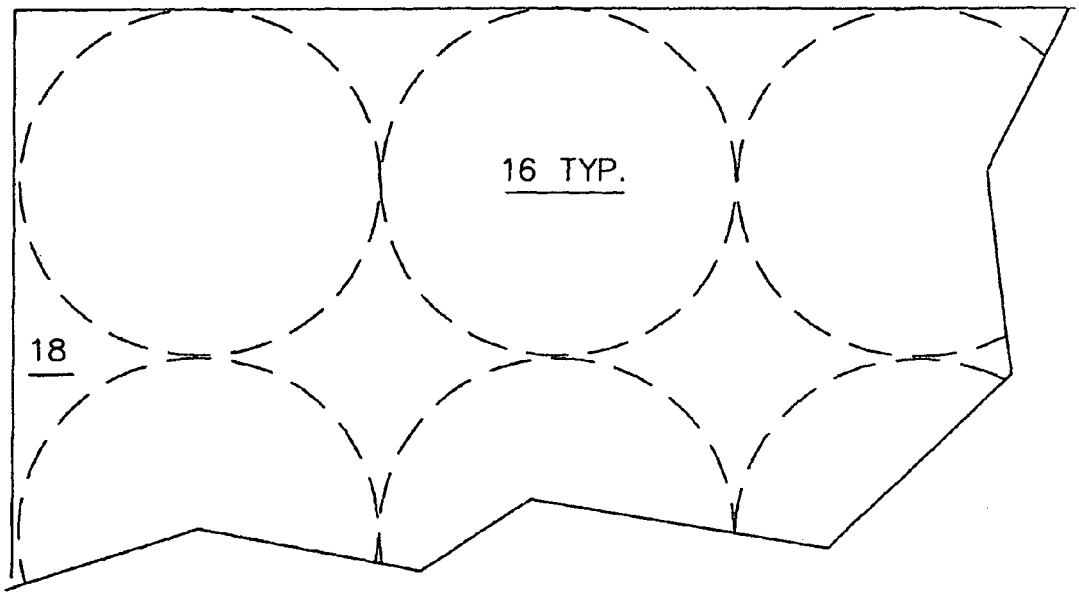
FIG. 16 is a plan view of a corner portion of a floor of a room showing the illumination pattern from a group of low-glare light fixtures of the present invention having circular light-exit apertures and arranged in a square array pattern.

FIG. 16 is a plan view of a corner portion of a floor 18 of a room showing the circular illumination pattern 16 from a group of low-glare light fixtures of the present invention having circular light-exit apertures and arranged in a square array pattern in the ceiling overhead. In this square array pattern, with the circles tangent as shown, the area within the circles can be calculated geometrically to cover about 78.5% of the total floor space. Since the beam-width limit is defined as the half-intensity point, the intensity would tend to remain full at the four tangent points of each circle and would fall below average only in the spaces between the circles. The 78.5 percent coverage decreases with height above the floor due to the conical beam shape, becoming zero at the level of the effective point light source, i.e. the crossover point shown in FIGS. 3 and 4.

In a room with an 8 foot ceiling, it is calculated that the eyes of a room occupant with an eye level of 5½ feet would be outside the conical illumination beams at approximately 65% of all possible room locations [−0.785 *(5.5/8.25)^2]. At these locations the light source, i.e. the recessed lamp, would be totally concealed from direct view by the light-exit aperture, and, as shown, the room occupant 31 would see, along line-of-sight path 29, only the distal internal wall of the duct portion 26B of the fixture, which being of the same material, texture and finish as the ceiling 10 would provide the desired authentic architectural built-in effect. In the remaining locations where the occupant is effectively beneath one of the fixtures, the angle of line-of-sight path 29 would become so steep, i.e. greater than 45 degrees, that it would be effectively outside the normal field of vision of the room occupant 31, since in the upward region, the effective field of vision is generally much less than 45 degree from horizontal. For normal viewing, the perception of glare would be minimal at all locations in the room: even with the occupant's head inclined back to look upwardly at angles exceeding 45 degrees, lamp 28 would become directly visible only in a small percentage of all room locations.

Figure 17:
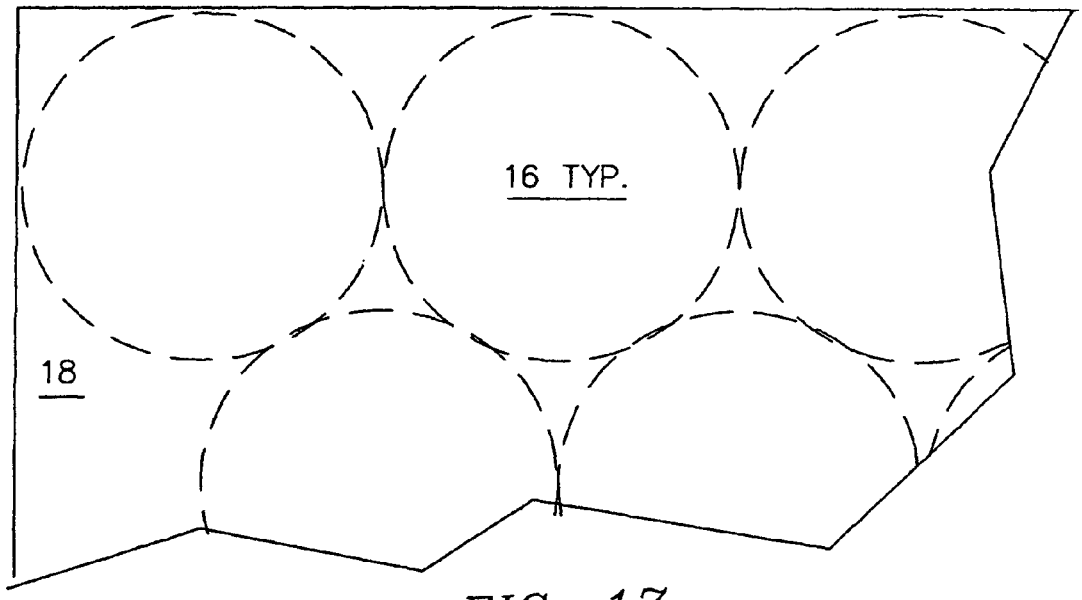
FIG. 17 is a plan view of a corner portion of a floor of a room as in FIG. 16 showing the illumination pattern from a group of low-glare light fixtures of the present invention having circular light-exit apertures and arranged in a triangular array pattern.

FIG. 17 is a plan view of a corner portion of a floor 18 of a room as in FIG. 16 with the circular light-exit aperture type fixtures in the ceiling overhead, but arranged instead in a triangular array pattern. In this triangular array pattern, with the circles tangent as shown, the area within the circles can be calculated geometrically to cover about 91% of the total floor space, again with the intensity remaining average at the tangent points and falling below average in the small spaces between the circles. Compared to the square array pattern of FIG. 13, the average light intensity is about 16% greater and the overall illumination is more uniform.

Uniform illumination of the entire floor 18 may be obtained by providing an array of similar lighting fixtures with square light-exit apertures in the ceiling arranged in a square pattern suitably spaced apart so as to provide the desired coverage in multiple square fields of illumination on floor as shown in FIG. 2. As an alternative to the square light-exit aperture, such uniform coverage could be obtained similarly by making the light-exit aperture rectangular in shape. If uniform illumination is required at some level above the floor 18, e.g. at desktop level, the ceiling fixtures would be arrayed closer together accordingly: the average room illumination would be higher and the illumination fields on floor 18 would overlap.

The main concept of the invention, i.e. forming a portion of the fixture as a plaster-compatible mounting unit to be plastered in place for integration with the surrounding ceiling (or wall), can be applied to practically any known type of light source in the same manner as shown above for popular types of light sources.

While casting from a composition of plaster and fiber reinforcement is suggested as the preferred manner and material for fabrication of the mounting unit that complies with applicable building codes, the invention could be practiced using other fabrication methods such as molding, other structural material such as plastic, concrete or metal, and/or other reinforcing material such as carbon fiber.

Practice of the present invention is not limited to indoor locations as described above: outdoor and/or "wet" locations can also be accommodated by selection of materials and by other weather-proofing measures of known art as a matter of design choice.

While the invention is directed mainly to conventional horizontal ceiling regions as shown and described herein, the terms "horizontal", "vertical", "upwardly" and "downwardly", as utilized for descriptive simplicity and ease of understanding, are not to be taken as limitations: there are special purposes, circumstances and instances of non-horizontal ceilings, e.g. arched or sloped or other non-horizontal locations where the invention may be practiced beneficially with fixtures oriented in various directions.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A low-glare light fixture mounting system, for permanent built-in recessed installation of a light fixture in an overhead surrounding ceiling region of a room, comprising:

a one-piece pre-cast mounting unit having two portions: (1) a planar face flange, surrounding a central light-exit aperture, of designated cross-sectional shape and size, extending horizontally to an orthogonal periphery with four edges, the face flange being configured to be fastened to building construction framing, to interface with surrounding sheet building material, to accept finish plastering, and to provide a uniform finished ceiling surface extending from the surrounding flat region to the light-exit aperture, and (2) a generally tubular duct extending perpendicularly from the flange and having a uniform interior cross-sectional shape and size replicating the cross-sectional shape and size of the light-exit aperture, extending upwardly from a boundary edge of the central light-exit aperture to an upper end constituting an attachment end at a designated height dimension, the interior of the duct and the bottom surface of the flange having a surface with finish, texture and appearance essentially the same as on the face flange and in the surrounding ceiling region;

a light source assembly, including at least one lamp providing a light source, along with an associated socket and wiring, mounted in an enclosure box attached to the upper end of the duct and located so as to project a light beam of designated beam width directed downwardly through the light-exit aperture;

the designated height dimension of the duct being made no less than the major horizontal dimension of the light-exit aperture;

all visible surface regions, both internal and external, of said mounting unit being made to have a finish, appearance and texture that match and blend in with the surface of the surrounding ceiling so as to present an authentic architectural built-in overall effect and appearance.

2. The low-glare light fixture mounting system as defined in claim 1 wherein:

the periphery of the face flange is made square in shape;

the light-exit aperture in the face flange of the mounting unit is made circular in shape and is centrally disposed in the face flange; and the duct is configured with a circular cross-section, conforming with the light-exit aperture, extending uniformly and linearly upwardly therefrom to the attachment end, which is made to be substantially parallel with the face flange.

3. The low-glare light fixture mounting system as defined in claim 1 wherein:

the periphery of the face flange is made rectangular in shape;

the light-exit aperture in the face flange is made rectangular in shape; and the duct of the mounting unit is made uniformly square in cross-sectional shape in conformance with the light-exit aperture, extending uniformly and linearly upwardly to the attachment end, which is made to be substantially parallel with the face flange.

4. The low-glare light fixture mounting system as defined in claim 1 wherein:

the periphery of the face flange is made square in shape;

the light-exit aperture in the face flange is made square in shape and is centrally disposed in the face flange; and the duct of the mounting unit is made uniformly square in cross-sectional shape in conformance with the light-exit aperture, extending uniformly and linearly upwardly to the attachment end, which is made to be substantially parallel with the face flange.

5. The low-glare light fixture mounting system as defined in claim 1 wherein the mounting unit is made integrally from composite material that is formulated to simulate conventional walls and ceilings with regard to strength, fireproofing, compliance with building regulations and compatibility with finish plastering.

6. The low-glare light fixture mounting system as defined in claim 5 wherein the mounting unit is made as a casting from material composed of plaster and fiber reinforcement.

7. A low-glare light fixture mounting system for permanent recessed installation of a light fixture in a flat region of a. ceiling of a room, comprising:

a one-piece pre-cast mounting unit having two portions: (1) a planar face flange, extending horizontally from a light-exit aperture having a designated cross-sectional shape and size, the mounting unit being made and arranged to be fastened to building construction framing and to interface with surrounding sheet building material in a manner to facilitate conventional drywall taping and to accept finish plastering in a manner to provide a uniform finished surface extending from the surrounding flat region of the ceiling to the light-exit aperture, and (2) a duct having a first end located at the face flange and extending around the light-exit aperture and thus having a cross-sectional shape and size defined by the light- exit aperture, the duct being configured generally as a vertical passageway with a uniform cross-sectional shape and size, replicating the cross-sectional shape and size of the light-exit aperture and extending upwardly from the light-exit aperture to an upper end that defines a plane that is located at a designated height dimension above the face flange and parallel to the face flange, constituting an attachment end, made and arranged to support light source components located so as to direct light therefrom through the light-exit aperture;

a light source assembly, including (a) an enclosure box, (b) at least one lamp and associated socket attached to the enclosure box, (c) attachment means for joining the enclosure box, lamp and socket to the attachment aperture end of the duct so as to direct light emitted from the lamp through the duct and the light-exit aperture, and (d) electrical wiring and associated electrical components as required for electrical installation and power line connection in accordance with conventional building practices and regulatory requirements;

said light source assembly and said mounting unit being made, dimensioned and arranged to project downwardly a light beam of designated beam width, the designated height dimension of the duct being made to totally conceal said light source assembly from any room viewpoint outside the light beam so that the only portion of the fixture that is visible is said mounting unit, of which all visible regions, both internal and external, are made to have finish, appearance and texture that match and blend in with the surface of the surrounding ceiling.

* * * * *